US005336343A

United States Patent [19]

Hamilton et al.

[11] Patent Number: 5,336,343

[45] Date of Patent: Aug. 9, 1994

[54] VINYL ETHERS AS NONAMMONIA PRODUCING BONDING AGENTS IN COMPOSITE PROPELLANT FORMULATIONS

[75] Inventors: R. Scott Hamilton, Bear River City; Robert B. Wardle, Logan; Jerald C. Hinshaw, Pleasant View, all of Utah

[73] Assignee: Thiokol Corporation, Ogden, Utah

[21] Appl. No.: 48,491

[22] Filed: Apr. 16, 1993

[51] Int. Cl.[5] ..... C06B 45/10

[52] U.S. Cl. ..... 149/19.9; 149/19.1; 149/19.4; 149/19.6

[58] Field of Search ..... 149/19.1, 19.4, 19.9, 149/19.6

[56] References Cited

U.S. PATENT DOCUMENTS

| | | | |
|---|---|---|---|
| 3,017,260 | 1/1962 | Arquette et al. | 149/60 |
| 3,022,280 | 2/1962 | Shukys et al. | 260/91.1 |
| 3,245,849 | 4/1966 | Klager et al. | 149/19.4 |
| 3,399,088 | 8/1968 | Christian et al. | 149/19 |
| 3,501,357 | 3/1970 | Suzuki et al. | 149/19 |
| 3,520,742 | 7/1970 | Witz | 149/19.1 |
| 3,589,954 | 6/1971 | Filter et al. | 149/19 |
| 3,720,553 | 3/1973 | Henderson | 149/19 |
| 4,090,893 | 5/1978 | Cueksee et al. | 149/19.9 |
| 4,214,928 | 7/1980 | Cousaga | 149/19.1 |
| 4,426,540 | 1/1984 | Shackelford et al. | 568/590 |
| 4,747,891 | 5/1988 | Finck et al. | 149/19.4 |
| 4,915,755 | 4/1990 | Kim | 149/19.4 |
| 4,944,815 | 7/1990 | Cousaga | 149/19.6 |
| 5,070,117 | 12/1991 | Klemarczyk et al. | 522/31 |

OTHER PUBLICATIONS

O. S. Gebizliouglu, et al., "A New Mechanism of Toughening Glassy Polymers. 1. Experimental Procedures", *Macromolecules*, 1990, vol. 23, pp. 3968–3974.

A. S. Argon, et al., "A New Mechanism of Toughening Glassy Polymers. Theoretical Approach", *Macromolecules*, 1990, vol. 23, pp. 3975–3982.

V. Crivello et al., "Aromatic Bisvinyl Ethers: A New Class of Highly Reactive Thermosetting Monomers", *Journal of Polymer Science: Polymer Chemistry Edition*, 1983, vol. 21, pp. 1785–1799.

"Bonding Agents–A Computer Literature Search Prepared for Gary Smith at NASA RECON", Aug. 1986, pp. 1–25.

Marjorie T. Ducote, "Amine Salts as AP Bonding Agents", 1983 JANNAF Propulsion Meeting, vol. II, CPIA Publication No. 370, 291–297.

Adolph E. Oberth, "Principles of Solid Propellant Development", *Chemical Propulsion Information Agency*, Publication 469, Sep. 1987, pp. 6–1 through 6–29.

*Primary Examiner*—Edward A. Miller

*Attorney, Agent, or Firm*—Madson & Metcalf

[57] ABSTRACT

Vinyl ethers for use as bonding agents in solid rocket propellants are disclosed. The vinyl ether bonding agents are capable of polymerizing in the presence of and around the surface of ammonium perchlorate particles. The bonding agents of the present invention are added to the propellant in a range from about 0.1% to about 3% by weight concentration. Importantly, there is no increase in ammonia liberated above baseline propellant values and no increase in end of mix viscosities by using the vinyl ethers according to the present invention which provides substantial processing savings.

20 Claims, 2 Drawing Sheets

VINYL ETHERS AS NONAMMONIA PRODUCING BONDING AGENTS IN COMPOSITE PROPELLANT FORMULATIONS

BACKGROUND OF THE INVENTION

1. Field of the Invention

This invention relates to bonding agents used in solid rocket propellants. More specifically, the present invention relates to vinyl ethers as nonammonia producing bonding agents.

2. Technology Background

Solid propellants are used extensively in the aerospace industry. Solid propellants have become a preferred method of powering most missiles and rockets for military, commercial, and space applications. Solid rocket motor propellants have become widely accepted because they are relatively simple to manufacture and use, and because they have excellent performance characteristics.

Typical solid rocket motor propellants are formulated using an oxidizing agent, a fuel, and a binder. At times, the binder and the fuel may be the same. In addition to the basic components, it is conventional to add various bonding agents, plasticizers, curing agents, cure catalysts, and other similar materials which aid in the processing or curing of the propellant or contribute to mechanical properties of the cured propellant. A significant body of technology has developed related solely to the processing and curing of solid propellants.

Many types of propellants used in the industry incorporate ammonium perchlorate (AP) as the oxidizer. The AP is generally incorporated into the propellant in particulate form. In order to hold the propellant in a coherent form, the components of the propellant are bound together by binder, such as, but not limited to, a hydroxy-terminated polybutadiene (HTPB) binder. Such binders are widely used and commercially available. It has been found that such propellant compositions are easy to manufacture and handle, have good performance characteristics, and are economical and reliable. As a result, this type of solid propellant has become a standard in the industry.

Propellants must generally meet various mechanical and chemical performance criteria to be considered acceptable for routine use. For example, it is important that the propellant have desired mechanical characteristics which allow it to be used in a corresponding rocket or missile. It is important that the propellant deform elastically during use to avoid cracking within the propellant grain.

If the propellant cracks, burning within the crack may be experienced during operation of the rocket or missile. Such, burning in a confined area may result in an increased surface area of burning propellant or increased burn rate at a particular location. This increase in the burn rate and surface area can directly result in failure of the rocket motor due to over pressurization or burn through of the casing.

Accordingly, propellants are typically subjected to standardized stress and strain tests. The typical configuration of the propellant sample tested is often referred to as a JANNAF Class C specimen. The shape and size of such specimens are standard in the industry. Such specimens are typically placed in an Instron ® testing apparatus and then pulled until the specimen fails. Data is recorded during such tests and objective measures of stress and strain performance are provided.

To make certain that propellant formulations meet the applicable specifications, it is often necessary to employ a bonding agent within the propellant composition. Bonding agents are widely used throughout the solid propellant industry to strengthen the polymeric matrix which binds the oxidizer and fuel together. They help to incorporate solid oxidizer particles into the polymeric binder system. Use of a bonding agent typically improves the stress and strain characteristics of the propellant.

A number of bonding agents are known and conventional. One class of bonding agents are the polyamine bonding agents TEPANOL ® (tetraethylenepentamine acrylonitrile glycidol adduct) and TEPAN ® (partially cyanoacrylated tetraethylenepentamine). TEPANOL ® and TEPAN ® are useful as bonding agents and improve the mechanical properties of isocyanate cured HTPB propellants. TEPANOL ® and TEPAN ® are believed to become chemically linked to the polymeric propellant binder. TEPANOL ® and TEPAN ® also electrostatically coordinate with the AP after forming a perchlorate salt from an acid/base reaction with AP. Thus, TEPANOL ® and TEPAN ® aid in binding the AP particles into the propellant matrix.

TEPANOL ® and TEPAN ®, however, also cause difficulty in the formulation of propellant. TEPANOL ® is relatively basic, and in the presence of AP produces a significant amount of ammonia. This makes it necessary to conduct propellant mixing steps under vacuum, and to mix for long periods of time in order to substantially remove the produced ammonia before addition of the curative. It often requires 24 hours or more to adequately remove the ammonia from TEPANOL ® and TEPAN ® systems. This significantly extends propellant processing time and increases costs. Insufficient removal of the ammonia can result in soft cures and nonreproducible mechanical properties because the free ammonia reacts with some of the isocyanate curing agent. These characteristics of TEPANOL ® and TEPAN ® result in significant disadvantages, such as long mix time, high labor costs, and AP attrition.

In another important class of bonding agents, the aziridines (i.e., cyclic ethylene imines), it is believed that a polymeric shell is formed directly around the oxidizer particles by homopolymerization, catalyzed by acidic AP. This hydrophobic layer is then more compatible with the continuous binder phase and results in better bonding of the AP particles. Since this reaction does not occur on nitramine surfaces, aziridines are limited to AP propellants.

Isophthaloyl-bis(methyl-ethyleneimide), known as HX-752 in the industry, is a widely used aziridine bonding agent. HX-752 has the following chemical structure:

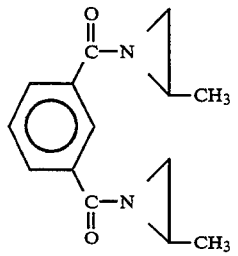

HX-752 is believed to be incorporated into the propellant matrix by ring opening polymerization. HX-752 avoids the production of large amounts of ammonia which plague processes using TEPANOL ®. As a result, some advantages are derived from the use of HX-752.

Even in view of the foregoing, HX-752 is far from ideal as a bonding agent. One significant problem is that of economics. HX-752 presently costs from four to five times as much as TEPANOL ®. Also, propellants produced using HX-752 have a relatively high mix viscosity, which inhibits processing. It is also believed that HX-752 may be a carcinogen. Thus, it can be seen that the cost and chemical characteristics of HX-752 make it a less than ideal bonding agent. Also, HX-752 as used in the industry does produce some ammonia which may require extra vacuum mixing.

In summary, conventional bonding agents have significant drawbacks. TEPANOL ® and TEPAN ® are problematic because of their tendency to produce large quantities of ammonia during propellant mixing and the other limitations mentioned above. Alternative materials, such as HX-752, also present problems including cost and poor processing characteristics of the propellant.

Accordingly, it would be an advancement in that art to provide bonding agents which overcame some of the significant limitations encountered using conventional bonding agents. A bonding agent which would not raise propellant viscosities and would not produce any ammonia would be an advancement in the art. Use of such a bonding agent would contribute to lower power requirements, shorter mixing times, lower labor costs, faster mixer turnaround times, and less AP attrition. It would also be an advancement in the art to provide such bonding agents which also resulted in propellants having acceptable stress and strain characteristics.

Such bonding agents are disclosed and claimed herein.

SUMMARY OF THE INVENTION

The invention is directed to the use of multifunctional vinyl ethers as bonding agents in solid rocket propellants which are capable of polymerizing in the presence of an acidic oxidizer, such as AP. The vinyl ether bonding agents used according to the present invention are preferably di or polyfunctional. The vinyl ether bonding agents of the present invention are added to the propellant in a range from about 0.1% to about 3% concentration by weight. Importantly, there is no increase in ammonia liberated and no increase in end of mix viscosity by use of the vinyl ethers according to the present invention.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings illustrate only typical embodiments of the invention and are not therefore to be considered limiting of its scope, the invention will be described and explained with additional specificity and detail through the use of the accompanying drawings in which.

DETAILED DESCRIPTION OF THE INVENTION

Figure 1:
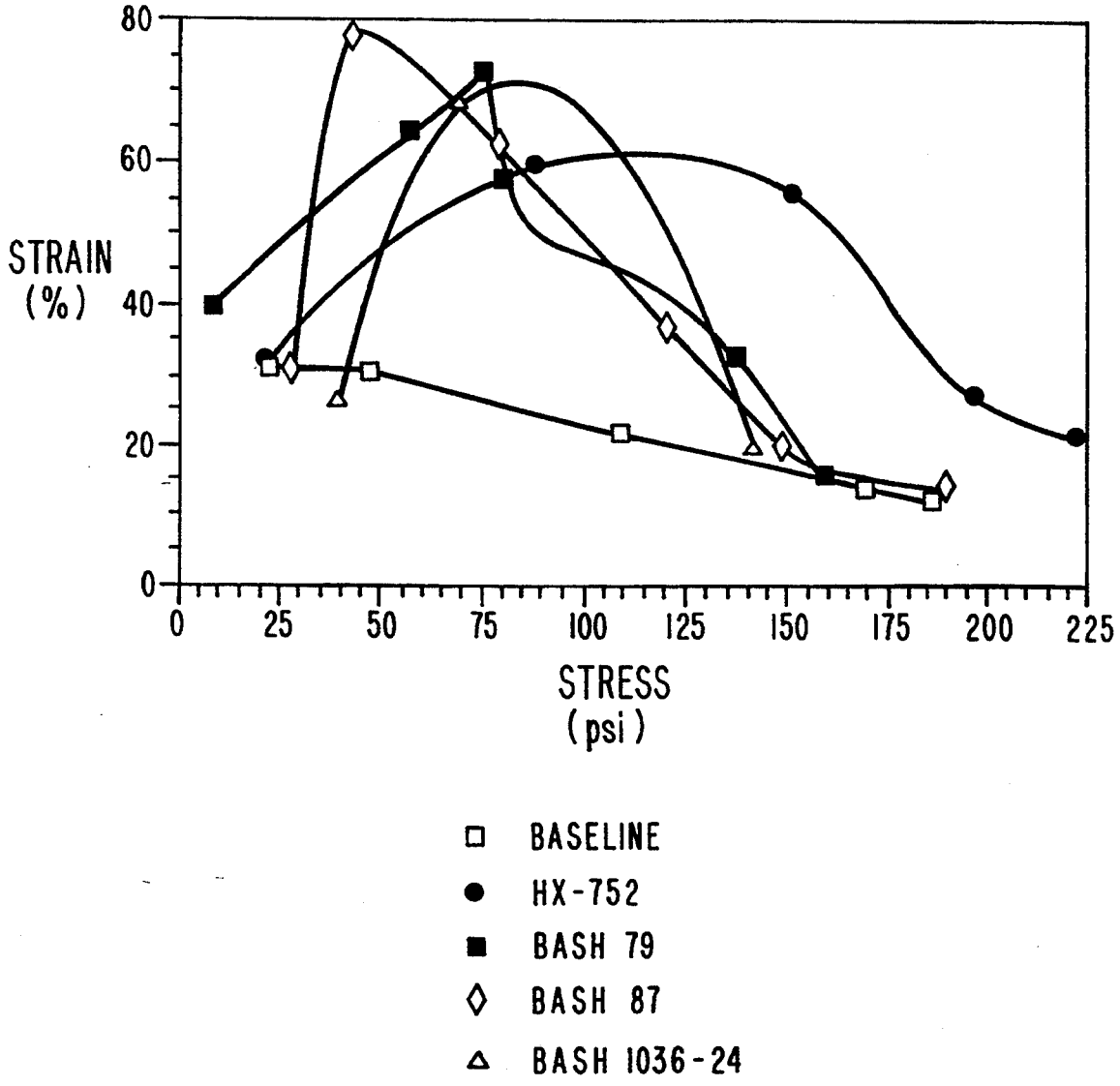
FIG. 1 is a graphical comparison of the stress/strain profile of a propellant formulation prepared using three bisvinyl ether bonding agents according to the present invention and the widely used aziridine HX-752 bonding agent compared against the propellant formulation without a bonding agent. These several stress strain values are for different curative (NCO:OH) ratios. The stress and strain values are uncorrected.

The present invention is directed to the use of multifunctional vinyl ethers as bonding agents in solid rocket propellants. The vinyl ethers within the scope of the present invention are capable of polymerizing in the presence of an acidic oxidizer, such as AP. Once polymerized, the vinyl ether bonding agents strengthen the polymeric matrix which holds the oxidizer and fuel together. It has been found that bonding agents having at least 2 vinyl ether functional groups provide best results.

The vinyl ether bonding agents of the present invention are added to the propellant in a range from about 0.1% to about 3% concentration by weight. Since bonding agents are nonenergetic propellant ingredients, the amount of bonding agents added to the propellant should be minimized. Although small amounts of ammonia are liberated in AP containing propellants, there is no increase in ammonia liberated by use of the vinyl ethers according to the present invention. In addition, viscosity measurements of propellants containing vinyl ether bonding agents of the present invention maintain the favorable processing viscosity of baseline propellants without a bonding agent. By contrast, HX-752 is known to increase propellant viscosity. Thus, use of the vinyl ether bonding agents of the present invention results in substantial propellant processing savings from a reduction of man hours and faster equipment turn around time.

The multifunctional vinyl ethers used within the scope of the present invention include cyclic and acyclic structures having reactive vinyl ether moieties, that is vinyl ethers which are susceptible to polymerization by a poor cationic polymerization catalyst, such as ammonium perchlorate or ammonium nitrate. The bonding agents of the present invention contain multiple vinyl ether functional groups, with preferably 2 or 3 vinyl ether groups. Although bonding agents having more than 3 vinyl ethers are embraced by the present invention, those skilled in the art will appreciate that such vinyl ethers are more complex to synthesize and are more expensive. The present invention also includes mixtures of multifunctional and monofunctional vinyl ethers such as mono- and difunctional vinyl ethers, mono- and trifunctional vinyl ethers, or mono-, di-, and trifunctional vinyl ethers.

One particularly preferred class of multifunctional vinyl ether bonding agents within the scope of the present invention have the following general formula:

$$(CH_2{=}CH{-}O{-}R_n)_m{-}X$$

where R is a linking group selected from $C_1$ to $C_{10}$ alkyl, branched alkyl, cycloalkyl, alkoxy, alkylamine, carbonyl, phenyl, substituted phenyl, phenoxyalkyl, substituted phenoxyalkyl, or monocyclic heterocyclic compounds; X is a polyvalent moiety selected from $C_1$ to $C_{10}$ alkyl, branched alkyl, cycloalkyl, oxygen, sulfur, nitrogen, carbonyl, imine, phenyl, substituted phenyl, or monocyclic heterocyclic compounds; n is 1 or 0; and m is 2 or 3. As used herein, phenyl substituents include, but are not limited to, lower alkyl, branched alkyl, halogen, nitro, amino, substituted amino, alkoxy, acyl, and carbonyl containing moieties such as carboxyl, ester, ketone, etc. As used herein, the alkyl groups in the phenoxyalkyl and substituted phenoxy alkyl include, but are not limited to $C_1$ to $C_{10}$ alkyl, branched alkyl, and cycloalkyl. The monocyclic heterocyclic compounds used herein include heteroatoms selected from nitrogen, sulfur, and oxygen. Possible heterocycles which may be used include piperazine and imidazolidone.

The following are examples of a few specific vinyl ethers which may be used as bonding agents within the scope of the present invention. They are intended to be purely exemplary and should not be viewed as a limitation on any claimed embodiment. The following vinyl ethers may be prepared according to the procedures described in Crivello and Conlon, "Aromatic Bisvinyl Ethers: A New Class of Highly Reactive Thermosetting Monomers," *Journal of Polymer Science: Polymer Chemistry Edition*, Vol. 21, pp. 1786–1787 (1983):

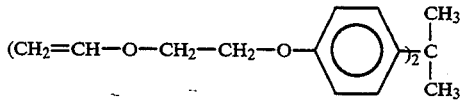

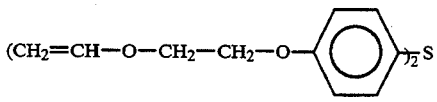

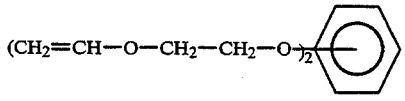

1,4

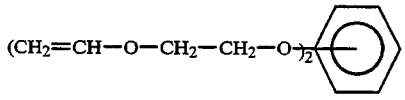

1,3

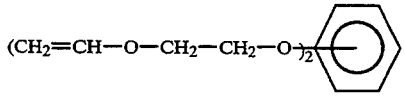

1,2

-continued

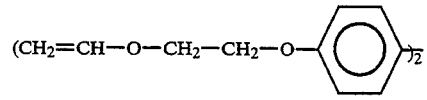

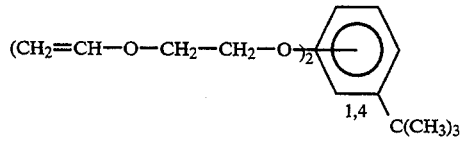

1,4 $C(CH_3)_3$

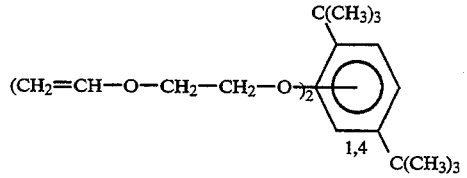

1,4 $C(CH_3)_3$

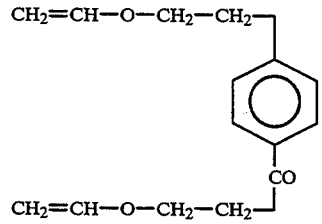

The following examples are offered to further illustrate the present invention. These examples are intended to be purely exemplary and should not be viewed as a limitation on any claimed embodiment.

EXAMPLE 1

A bisvinyl ether having the following structure (herein after referred to as "BASH 79"), was synthesized and demonstrated in a propellant formulation:

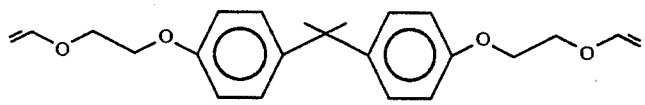

BASH 79 was prepared by reacting 50 g bisphenol A (2,2-isopropylidine-4,4'-bisphenol) and 70 g of 2-chloroethylvinylether in the presence of 26.28 g of finely powdered NaOH in 75 mL dimethylsulfoxide (DMSO) solvent according to the procedure described in Crivello and Conlon, "Aromatic Bisvinyl Ethers: A New Class of Highly Reactive Thermosetting Monomers," *Journal of Polymer Science: Polymer Chemistry Edition*, Vol. 21, pp. 1786–1787 (1983).

The resulting bisvinyl ether bonding agent, BASH 79, was used at 0.15 percent concentration by weight in an 87 percent solids propellant formulation as follows:

| Ingredient | Weight % |
|---|---|
| HTPB & curative | 12.85 |
| Bonding agent | 0.15 |
| Al | 18.00 |
| AP | 69.00 |

The propellant processed well, having an end of mix viscosity of about 5 kP. There was no increase in ammonia liberated above baseline propellant values. The propellant had a strain of about 60 percent at 100 psi stress. By way of comparison, the baseline propellant formulation produced strain capabilities of about 25 percent at 100 psi stress. FIG. 1 contains a stress versus strain graph of the solid rocket propellant formulations using the BASH 79 bonding agent. The data depicted in FIG. 1 suggest that BASH 79 functions as a bonding agent.

EXAMPLE 2

An bisvinyl ether having the following structure (herein after referred to as "BASH 87"), was synthesized and demonstrated in a propellant formulation:

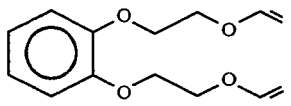

BASH 87 was prepared by reacting 25.00 g catechol ( 1,2-benzenediol) and 72.56 g of 2-chloroethylvinylether in the presence of 38.20 g of finely powdered KOH in 150 mL DMSO solvent according to the procedure described in the *Journal of Polymer Science: Polymer Chemistry Edition*, Vol. 21, pp. 1786–1787 (1983).

The resulting bisvinyl ether bonding agent, BASH 87, was used at 0.15 percent concentration by weight in an 87 percent solids propellant formulation as set forth in Example 1. The propellant processed well, having an end of mix viscosity of about 10 kP. There was no increase in ammonia liberated above baseline propellant values. The propellant had a strain of about 47 percent at 100 psi stress. By way of comparison, the baseline propellant formulation produced strain capabilities of about 25 percent at 100 psi stress. FIG. 1 contains a stress versus strain graph of the solid rocket propellant formulations using the BASH 87 bonding agent. The data depicted in FIG. 1 suggest that BASH 87 functions as a bonding agent.

EXAMPLE 3

A bisvinyl ether having the following structure (herein after referred to as "BASH 1036-24"), was synthesized and demonstrated in a propellant formulation:

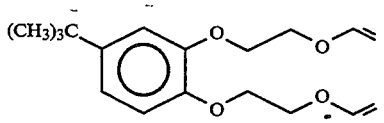

BASH 1036-24 was prepared by reacting 13.02 g t-butylcatechol (4-(1,1-dimethyl-ethyl)-1,2-benzenediol) and 25.00 g of 2-chloroethylvinylether in the presence of 9.4 g of finely powdered NaOH in 100 mL DMSO solvent according to the procedure described in the *Journal of Polymer Science: Polymer Chemistry Edition*, Vol. 21, pp. 1786–1787 (1983).

The resulting bisvinyl ether bonding agent, BASH 1036-24, was used at 0.15 percent concentration by weight in an 87 percent solids propellant formulation as set forth in Example 1. The propellant processed well, having an end of mix viscosity of about 8 kP. There was no increase in ammonia liberated above baseline propellant values. The propellant had a strain of about 68 percent at 70 psi stress. By way of comparison, the baseline propellant formulation produced strain capabilities of about 27 percent at 70 psi stress. FIG. 1 contains a stress versus strain graph of the solid rocket propellant formulations using the BASH 1036-24 bonding agent. The data depicted in FIG. 1 suggest that BASH 1036-24 functions as a bonding agent.

EXAMPLE 4

In this example, various concentrations of BASH 79, prepared according to Example 1, were used in a propellant formulation. 0.1%, 0.15%, and 0.2% by weight BASH 79 were added to a propellant formulation as set forth below:

| Ingredient | Weight % | | |
|---|---|---|---|
| HTPB & curative | 12.90 | 12.85 | 12.80 |
| Bonding agent | 0.10 | 0.15 | 0.20 |
| Al | 18.00 | 18.00 | 18.00 |
| AP | 69.00 | 69.00 | 69.00 |

Figure 2:
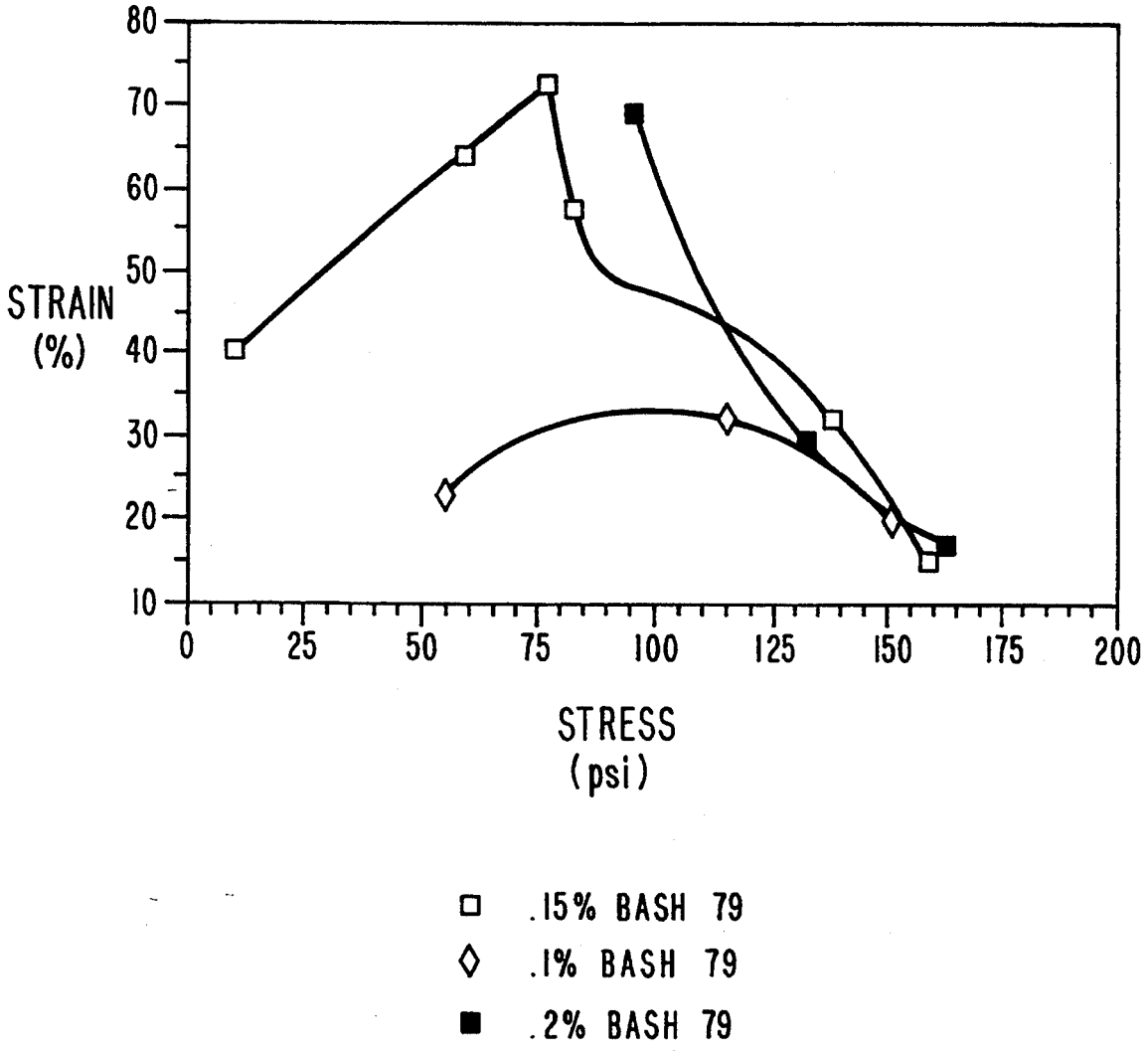
FIG. 2 is a graphical comparison of the stress/strain profile of a propellant formulation prepared with three different concentrations of a bisvinyl ether bonding agent according to the present invention.

The effect of concentration on the mechanical properties of the solid rocket propellant was examined. FIG. 2 is a stress versus strain graph comparing the propellant formulations having the different concentrations of bisvinyl ether bonding agent BASH 79. The data depicted in FIG. 2 suggests that BASH 79 functions most effectively as a bonding agent at greater than 0.1% concentration.

From the foregoing it will be appreciated that the present invention provides effective solid propellant bonding agents which do not liberate ammonia and do not raise propellant viscosities. Use of such bonding agents contributes to lower power requirements, shorter mixing times, lower labor costs, faster mixer turnaround times, and less AP attrition.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A solid propellant composition comprising:

an oxidizing salt which functions as a cationic polymerization catalyst present in an amount ranging from about 40% to about 86% by weight;

a fuel present in an amount ranging from about 0% to about 21% by weight;

hydroxy-terminated polybutadiene binder present in an amount ranging from about 8% to about 20% by weight; and a bonding agent comprising a compound having multiple vinyl ether functional groups present in an amount ranging from about 0.1% to about 3% by weight.

2. A solid propellant composition as defined in claim 1, wherein the vinyl ether bonding agent has the following general formula:

$$(CH_2{=}CH{-}O{-}R_n)_m{-}X$$

where R is a linking group selected from $C_1$ to $C_{10}$ alkyl, branched alkyl, cycloalkyl, alkoxy, alkylamine, carbonyl, phenyl, substituted phenyl, phenoxyalkyl, substituted phenoxyalkyl, or monocyclic heterocyclic compounds; X is a polyvalent moiety selected from $C_1$ to $C_{10}$ alkyl, branched alkyl, cycloalkyl, oxygen, sulfur, nitrogen, carbonyl, imine, phenyl, substituted phenyl, or monocyclic heterocyclic compounds; n is 1 or 0; and m is 2 or 3.

3. A solid propellant composition as defined in claim 2, wherein the fuel includes aluminum particles.

4. A solid propellant composition as defined in claim 2, wherein the fuel includes magnesium particles.

5. A solid propellant composition as defined in claim 2, wherein the oxidizing salt is ammonium perchlorate.

6. A solid propellant composition as defined in claim 2, wherein the oxidizing salt is ammonium nitrate.

7. A solid propellant composition as defined in claim 2, wherein the vinyl ether bonding agent is:

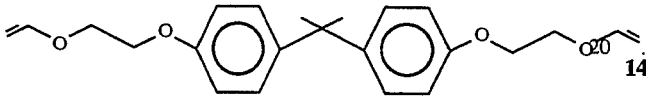

8. A solid propellant composition as defined in claim 2, wherein the bisvinyl ether is:

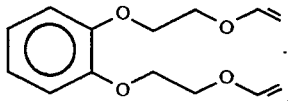

9. A solid propellant composition as defined in claim 2, wherein the vinyl ether bonding agent is:

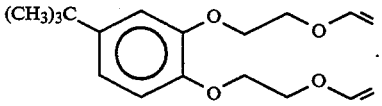

10. A solid propellant compositions as defined in claim 1, wherein the bonding agent comprises a mixture of a monofunctional vinyl ether and a multifunctional vinyl ether.

11. A composite rocket propellant comprising:

an oxidizing salt which functions as a cationic polymerization catalyst;

a hydroxy-terminated polybutadiene binder; and a bonding agent, said bonding agent comprising a compound having multiple vinyl ether functional groups which are capable of being polymerized by said oxidizing salt.

12. A composite rocket propellant as defined in claim 11, wherein the oxidizing salt is ammonium perchlorate.

13. A composite rocket propellant as defined in claim 11, wherein the oxidizing salt is ammonium nitrate.

14. A composite rocket propellant comprising:

an oxidizing salt which functions as a cationic polymerization catalyst;

a hydroxy-terminated polybutadiene binder; and a bonding agent, said bonding agent comprising a compound having multiple vinyl ether functional groups having the following general formula:

$$(CH_2{=}CH{-}O{-}R_n)_m{-}X$$

where R is a linking group selected from $C_1$ to $C_{10}$ alkyl, branched alkyl, cycloalkyl, alkoxy, alkylamine, carbonyl, phenyl, substituted phenyl, phenoxyalkyl, substituted phenoxyalkyl, or monocyclic heterocyclic compounds; X is a polyvalent moiety selected from $C_1$ to $C_{10}$ alkyl, branched alkyl, cycloalkyl, oxygen, sulfur, nitrogen, carbonyl, imine, phenyl, substituted phenyl, or monocyclic heterocyclic compounds; n is 1 or 0; and m is 2 or 3.

15. A composite rocket propellant as defined in claim 14, wherein the bonding agent is:

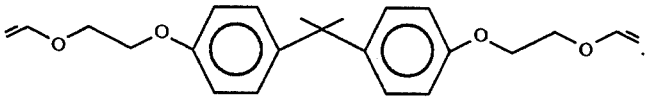

16. A composite rocket propellant as defined in claim 14, wherein the bonding agent is:

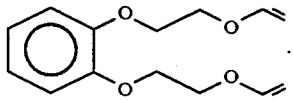

17. A composite rocket propellant as defined in claim 14, wherein the bonding agent is:

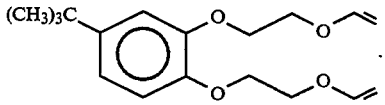

18. A composite rocket propellant as defined in claim 14, further comprising a second bonding agent comprising a compound having a single vinyl ether functional group in combination with the bonding agent comprising a compound having multiple vinyl ether functional groups, said second bonding agent comprising a compound having a single vinyl ether functional group having a general formula as defined in claim 14, except that m is 1.

19. A composite rocket propellant as defined in claim 14, wherein the oxidizing salt is ammonium perchlorate.

20. A composite rocket propellant as defined in claim 14, wherein the oxidizing salt is ammonium nitrate.

* * * * *